US010717293B2

(12) United States Patent
Ishikawa

(10) Patent No.: US 10,717,293 B2
(45) Date of Patent: Jul. 21, 2020

(54) LIQUID CIRCULATION APPARATUS, LIQUID EJECTION APPARATUS AND LIQUID EJECTION METHOD

(71) Applicant: TOSHIBA TEC KABUSHIKI KAISHA, Tokyo (JP)

(72) Inventor: Hiroyuki Ishikawa, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/224,871

(22) Filed: Dec. 19, 2018

(65) Prior Publication Data

US 2019/0118546 A1 Apr. 25, 2019

Related U.S. Application Data

(63) Continuation of application No. 15/469,774, filed on Mar. 27, 2017, now abandoned, which is a (Continued)

(30) Foreign Application Priority Data

Sep. 3, 2014 (JP) ..... 2014-179630

(51) Int. Cl.
*B41J 2/18* (2006.01)
*B41J 2/175* (2006.01)

(Continued)

(52) U.S. Cl.
CPC ..... *B41J 2/18* (2013.01); *B41J 2/14233* (2013.01); *B41J 2/175* (2013.01); *B41J 2/17509* (2013.01);

(Continued)

(58) Field of Classification Search
CPC ..... B41J 2/18; B41J 2/17596; B41J 2/14233; B41J 29/38; B41J 2/175; B41J 2/17556;

(Continued)

(56) References Cited

U.S. PATENT DOCUMENTS 9,636,921 B2 5/2017 Ishikawa
2003/0202057 A1 10/2003 Childs et al.

(Continued)

FOREIGN PATENT DOCUMENTS

JP 2010-221589 10/2010
JP 2011-148101 8/2011

(Continued)

OTHER PUBLICATIONS

Non-Final Office Action for U.S. Appl. No. 14/812,075 dated Feb. 25, 2016, 44 pages.

(Continued)

*Primary Examiner* — Huan H Tran
(74) *Attorney, Agent, or Firm* — Amin, Turocy & Watson, LLP

(57) ABSTRACT

In accordance with an embodiment, a liquid circulation apparatus comprises a liquid chamber configured to hold liquid which is to be supplied to a liquid ejection section ejecting liquid, a circulation section configured to circulate the liquid between the liquid chamber and the liquid ejection section, a liquid replenishment section configured to replenish liquid to the liquid chamber, a gas replenishment section configured to replenish gas to the liquid chamber, a pressure detection section configured to detect pressure of the liquid chamber, and a control section configured to adjust pressure of the liquid ejection section by replenishing the liquid to the liquid chamber with the liquid replenishment section and replenishing the gas to the liquid chamber with the gas replenishment section.

12 Claims, 10 Drawing Sheets

Related U.S. Application Data continuation of application No. 14/812,075, filed on Jul. 29, 2015, now Pat. No. 9,636,921.

(51) Int. Cl.

| | |
|---|---|
| ***B41J 29/38*** | (2006.01) |
| ***B41J 2/14*** | (2006.01) |
| *B41J 2/185* | (2006.01) |

(52) U.S. Cl.

CPC ..... *B41J 2/17556* (2013.01); *B41J 2/17596* (2013.01); *B41J 29/38* (2013.01); *B41J 2002/14419* (2013.01); *B41J 2002/1853* (2013.01); *B41J 2202/12* (2013.01)

(58) Field of Classification Search

CPC ..... B41J 2/17509; B41J 2002/1853; B41J 2202/12; B41J 2002/14419

See application file for complete search history.

(56) References Cited

U.S. PATENT DOCUMENTS

| | | | |
|---|---|---|---|
| 2010/0013883 | A1 | 1/2010 | Nishimura et al. |
| 2012/0127244 | A1 | 5/2012 | Suzuki |
| 2014/0125745 | A1 | 5/2014 | Igawa |
| 2014/0292963 | A1 | 10/2014 | Hara et al. |
| 2015/0070415 | A1 | 3/2015 | Ishikawa et al. |

FOREIGN PATENT DOCUMENTS

| | | |
|---|---|---|
| JP | 2012-218303 | 11/2012 |
| JP | 2014-172324 | 9/2014 |

OTHER PUBLICATIONS

Final Office Action for U.S. Appl. No. 14/812,075 dated Aug. 15, 2016, 22 pages.

Japanese Office Action for Japanese Patent Application No. 2014-179630 dated Feb. 6, 2018.

Non-Final Office Action for U.S. Appl. No. 15/469,774 dated Mar. 9, 2018, 30 pages.

Final Office Action for U.S. Appl. No. 15/469,774 dated Sep. 19, 2018.

LIQUID CIRCULATION APPARATUS, LIQUID EJECTION APPARATUS AND LIQUID EJECTION METHOD

CROSS-REFERENCE TO RELATED APPLICATIONS

This application is a Continuation of application Ser. No. 15/469,774 filed Mar. 27, 2017, which is a Continuation of application Ser. No. 14/812,075 filed Jul. 29, 2015, the entire contents of both of which are incorporated herein by reference.

This application is based upon and claims the benefit of priority from Japanese Patent Application No. 2014-179630, filed Sep. 3, 2014, the entire contents of which are incorporated herein by reference.

FIELD

Embodiments described herein relate generally to a liquid circulation apparatus, a liquid ejection apparatus and a liquid ejection method.

BACKGROUND

There is provided a liquid ejection apparatus which supplies liquid from a liquid tank to a liquid ejection head having a nozzle to eject the liquid from the nozzle. There is known a technology in which the printing operation is not stopped and the liquid is replenished to adjust pressure when it is detected that the liquid in the liquid tank is decreased in the liquid ejection apparatus.

DETAILED DESCRIPTION

Figure 1:
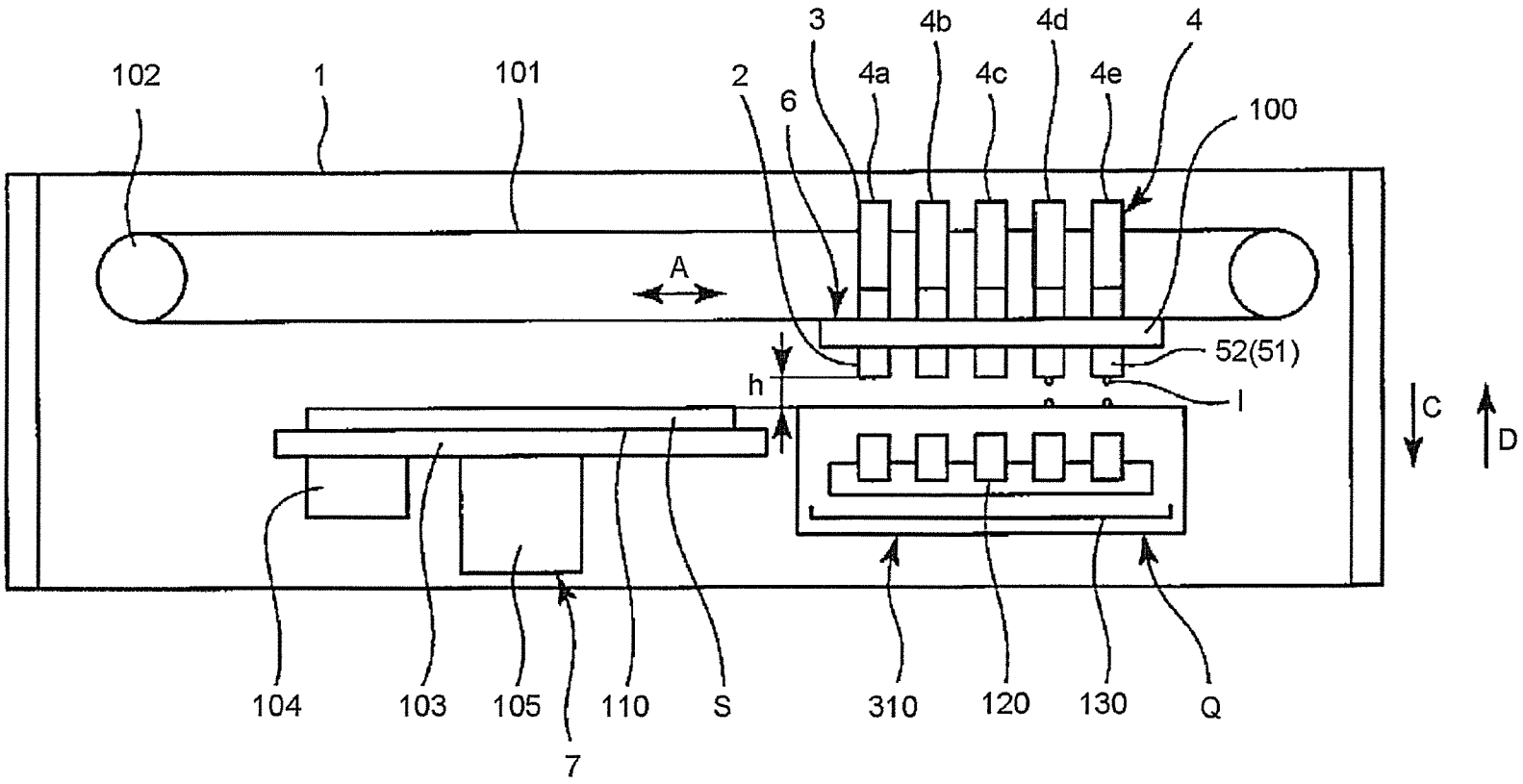
FIG. 1 is a cross-sectional view illustrating an inkjet recording apparatus according to an embodiment.

In accordance with an embodiment, a liquid circulation apparatus comprises a liquid chamber configured to hold liquid which is to be supplied to a liquid ejection section ejecting liquid, a circulation section configured to circulate the liquid between the liquid chamber and the liquid ejection section, a liquid replenishment section configured to replenish liquid to the liquid chamber, a gas replenishment section configured to replenish gas to the liquid chamber, a pressure detection section configured to detect pressure of the liquid chamber, and a control section configured to adjust pressure of the liquid ejection section by replenishing the liquid to the liquid chamber with the liquid replenishment section and replenishing the gas to the liquid chamber with the gas replenishment section.

Embodiment

Hereinafter, an inkjet recording apparatus 1 according to the present embodiment is described with reference to FIG. 1-FIG. 8. For facilitating the description, the constitution shown in the drawings may be properly enlarged, reduced or omitted. Further, same constitutions or similar constitutions are applied with same reference numerals.

Figure 2:
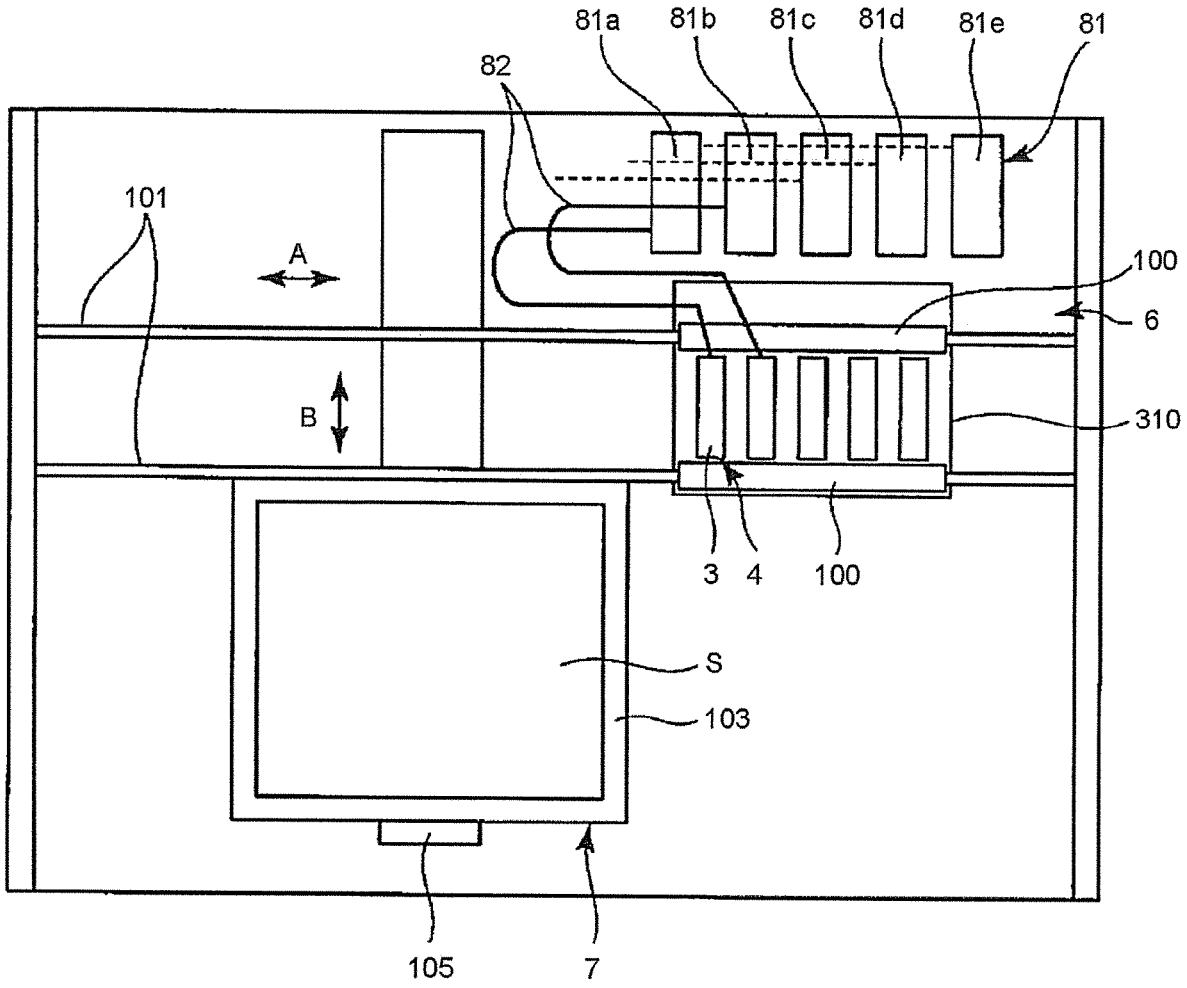
FIG. 2 is a plan view illustrating the inkjet recording apparatus according to the embodiment.

FIG. 1 is a front view of the inkjet recording apparatus 1, and FIG. 2 is a plan view of the inkjet recording apparatus 1. As shown in FIG. 1 and FIG. 2, an inkjet recording apparatus 1 serving as a liquid ejection apparatus comprises an image forming section 6, an image receiving medium movement section 7 serving as a conveyance section and a maintenance unit 310.

The image forming section 6 comprises an inkjet recording section 4, a carriage 100 which supports the inkjet recording section 4, a conveyance belt 101 which enables the carriage 100 to reciprocate in a direction indicated by an arrow A, and a carriage motor 102 which drives the conveyance belt 101.

The inkjet recording section 4 comprises an inkjet head 2 serving as an ejection section (liquid ejection section) and an ink circulation device 3 serving as a circulation section. The ink circulation device 3 is arranged above the inkjet head 2 to be formed integrally with the inkjet head 2. The inkjet recording section 4 ejects ink to an image receiving medium S to form a desired image.

For example, the inkjet recording section 4 comprises inkjet recording sections 4*a*, 4*b*, 4*c*, 4*d* and 4*e* which respectively ejects cyan ink, magenta ink, yellow ink, black ink and white ink. No limitation is given to the color or characteristic of the ink used by each of the inkjet recording sections 4*a*, 4*b*, 4*c*, 4*d* and 4*e*. For example, the inkjet recording section 4*e* may eject a transparent ink, a special ink which generates a color when irradiating infrared ray or ultraviolet ray instead of the white ink. The inkjet recording section 4*a*, 4*b*, 4*c*, 4*d* and 4*e* have same constitutions while using different ink. Thus, the inkjet recording section 4*a*, 4*b*, 4*c*, 4*d* and 4*e* are described using common reference numerals.

The width of the inkjet recording section 4 is narrowed by stacking the ink circulation section 3 on the inkjet head 2. Thus, the width of the carriage 100 which supports the plurality of inkjet recording sections 4*a*-4*e* in parallel can be narrowed. In this way, the image forming section 6 can reduce the conveyance distance of the carriage 100, and it is possible to reduce the size of the inkjet recording apparatus 1 and improve the printing speed.

The image forming section 6 comprises an ink cartridge 81 for newly replenishing ink to the ink circulation device 3. The 81*a*, 81*b*, 81*c*, 81*d* and 81*e* of the ink cartridges 81 respectively hold the cyan ink, magenta ink, yellow ink, black ink and white ink. The ink cartridges 81*a*, 81*b*, 81*c*,

81*d* and 81*e* have same constitutions while holding different ink. Thus, the ink cartridges 81*a*, 81*b*, 81*c*, 81*d* and 81*e* are described using common reference numerals. The ink cartridge 81 is communicated with the ink circulation device 3 of the inkjet recording section 4 through tubes 82. The ink cartridge 81 is arranged relatively below the ink circulation device 3 in the gravity direction.

The image receiving medium movement section 7 is provided with a table 103 which adsorps and fixes the image receiving medium S. The table 103 is installed in a slide rail device 105 and is reciprocated in a direction indicated by an arrow B. The pressure inside the table 103 becomes a negative pressure through a pump 104, and thus the table 103 adsorps and fixes the image receiving medium S from a hole 110 having a small diameter on the top surface of the table 103. During a period when the inkjet recording section 4 reciprocates along the conveyance belt 101 in the direction indicated by the arrow A, a distance h between a nozzle plate 52 of the inkjet head 2 and the image receiving medium S is maintained to be constant. The inkjet head 2 comprises 300 nozzles 51 serving as liquid ejection sections in the longitudinal direction of the nozzle plate 52. The longitudinal direction of the nozzle plate 52 is the same as the conveyance direction of the image receiving medium S.

The image forming section 6 enables the inkjet head 2 to reciprocate in a direction orthogonal to the conveyance direction of the image receiving medium S, and forms an image on the image receiving medium S. The inkjet head 2 ejects ink I from the nozzle 51 arranged in the nozzle plate 52 in response to an image forming signal to form the image on the image receiving medium S. The inkjet recording section 4 forms the image having a width of 300 nozzles (for example) on the image receiving medium S.

The maintenance unit 310 is arranged at a position outside a movement range of the table 103, that is, the scanning range of the inkjet recording section 4 in the direction indicated by the arrow A. The inkjet head 2 faces the maintenance unit 310 at a standby position Q. The maintenance unit 310 is a case opened on the upper side thereof, and is arranged in a movable manner vertically (in the directions respectively indicated by an arrow C and an arrow D in FIG. 1).

In a case in which the carriage 100 moves in the direction indicated by the arrow A to print the image, the maintenance unit 310 moves downward (in the direction indicated by the arrow C) to separate from the nozzle plate 52. In a case in which the print operation is ended, the maintenance unit 310 moves upward (in the direction indicated by the arrow D). When the print operation is ended and the inkjet head 2 returns to the standby position Q, the maintenance unit 310 moves upward to cover the nozzle plate 52 of the inkjet head 2. The maintenance unit 310 prevents evaporation of ink from the nozzle plate 52, and prevents dust and paper dust from adhering to the nozzle plate 52. The maintenance unit 310 functions as a cap of the nozzle plate 52.

The maintenance unit 310 comprises a rubber blade 120 and a waste ink receiving section 130. The rubber blade 120 removes the ink, dust, paper dust and the like adhered to the nozzle plate 52 of the inkjet head 2. The waste ink receiving section 130 receives the waste ink, dust, paper dust and the like generated during the period the maintenance operation is carried out. The maintenance unit 310 has a function of moving the blade 120 towards the direction indicated by the arrow B, and wipes the surface the nozzle blade 52 with the blade 120.

In order to remove the deteriorated ink nearby the nozzle, the inkjet head 2 carries out the maintenance (spit function) forcibly ejecting the ink from the nozzle 51. The inkjet head 2 carries out maintenance (purge function) in which little ink is flowed out from the nozzles 51, the paper dust and dust that are adhered to the surface of the inkjet head 2 are acquired into the flowed ink film, and then wiped away with the blade 120. The waste ink receiving section 130 collects the waste ink generated at the time of carrying out the spit function or the purge function.

The inkjet recording apparatus 1 enables the inkjet head 2 to reciprocate in the direction orthogonal to the conveyance direction of the image receiving medium S by the image receiving medium movement section 7 and ejects the ink from the nozzles 51 to form an image on the image receiving medium S.

No limitation is given to the constitution of the inkjet recording apparatus 1. For example, in order to move the image receiving medium, a device which moves the image receiving medium by winding a roll-shaped image receiving medium in a direction orthogonal to the movement direction of the inkjet recording section 4 may be used instead of the table 103. Alternatively, a device which moves a sheet-like image receiving medium through a platen roller in a direction orthogonal to the movement direction of the inkjet recording section 4 may be used.

Figure 3:
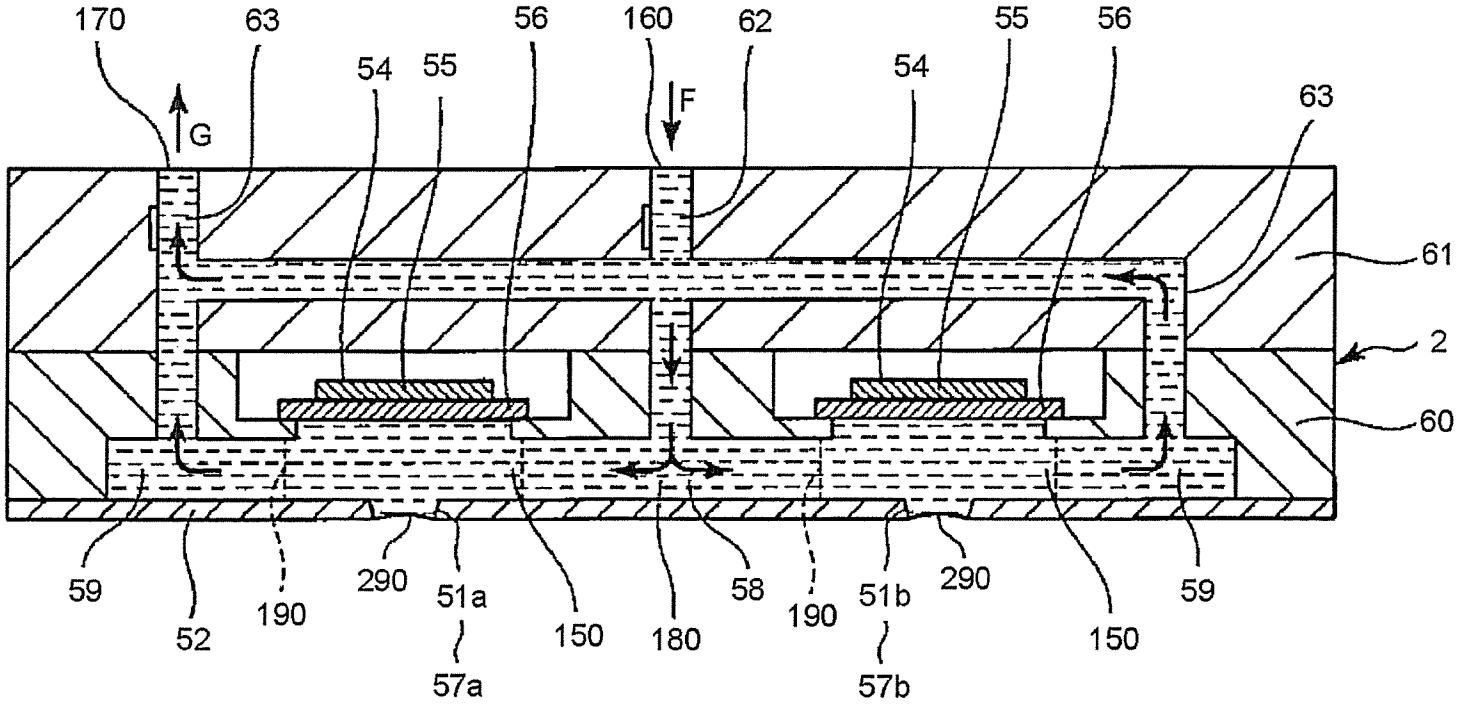
FIG. 3 is an illustration diagram illustrating an inkjet head according to the embodiment.
Figure 4:
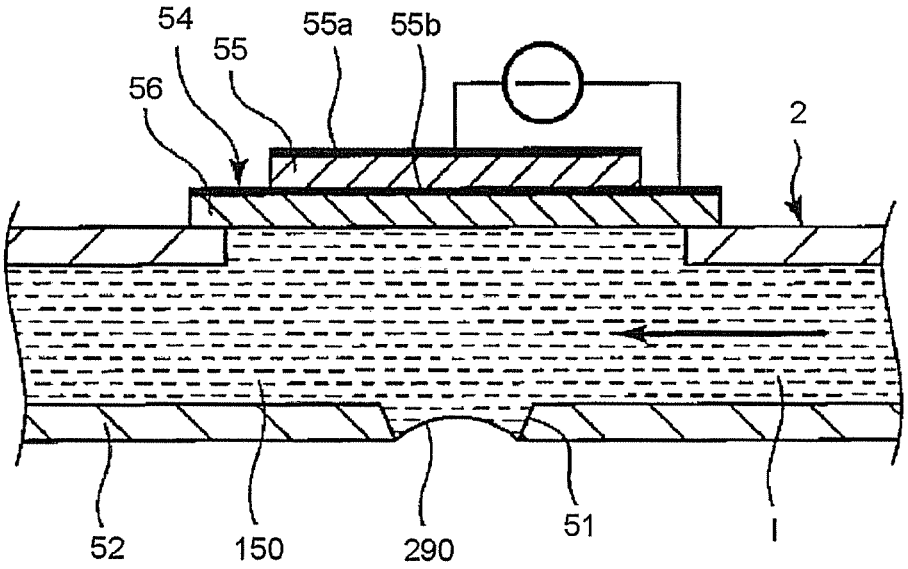
FIG. 4 is an illustration diagram illustrating a state in which ink stays in a nozzle of the inkjet head according to the embodiment.

For example, as shown in FIG. 3 and FIG. 4, the inkjet head 2 comprises a substrate 60 consisting of actuators 54 and the nozzle plate 52 provided with nozzles 51, and a manifold 61 which is communicated with the substrate 60. The substrate 60 includes an ink flow path 180 where ink flows between the nozzles 51 and the actuators 54. The actuators 54 face the ink flow path 180, and are arranged corresponding to each nozzle 51.

The substrate 60 is provided with a boundary wall 190 between adjacent nozzles 51 such that the pressure generated in the ink of the ink flow path 180 by the actuator 54 is concentrated in the nozzle 51. The ink flow path 180 surrounded by the nozzle plate 52, the actuator 54 and the boundary wall 190 constitutes an ink pressure chamber 150. A plurality of ink pressure chambers 150 are arranged corresponding to each nozzle 51*a* of a first nozzle array 57*a* and each nozzle 51*b* of a second nozzle array 57*b*. The first nozzle array 57*a* and the second nozzle array 57*b* respectively comprise 300 nozzles 51*a* and 300 nozzles 51*b*.

The substrate 60 comprises a common ink supply chamber 58 which supplies ink to the plurality of pressure chambers 150 and a common ink chamber 59 which collects the ink from the plurality of ink pressure chambers 150 at the first nozzle array 57*a* side and the second nozzle array 57*b* side, respectively.

The manifold 61 comprises an ink supply port 160 which enables the ink to flow towards a direction indicated by an arrow F and an ink discharge port 170 which discharges the ink towards a direction indicated by an arrow G. The ink I is supplied from the ink circulation device 3 to the ink supply port 160, and the ink is returned from the ink discharge port 170 to the ink circulation device 3. The manifold 61 has an ink distribution passage 62 communicating with the common ink supply chamber 58 from the ink supply port 160. The manifold 61 has an ink reflux passage 63 communicating with the ink discharge port 170 from the common ink chamber 59.

That is, the ink flow path 180 is formed inside the inkjet head 2 through the substrate 60, the manifold 61 and the nozzle plate 52. The ink flow path 180 consists of the plurality of ink pressure chambers 150 communicating with the nozzles 51*a* and 51*b*, the ink supply port 160 and the ink discharge port 170 which are formed in the manifold 61, the common ink supply chamber 58 communicated with the plurality of ink pressure chambers 150, the common ink chamber 59 collecting ink from the plurality of ink pressure chambers 150, the ink distribution passage 62 communicating with the common ink supply chamber 58 from the ink supply port 160, and the ink reflux passage 63 communicating with the ink discharge port 170 from the common ink chamber 59.

The ink I flows on the ink distribution passage 62 in the direction indicated by the arrow F flows from the common ink supply chamber 58 to the plurality of ink pressure chambers 150. The ink I that isn't ejected from the nozzles 51 in the ink pressure chambers 150 flows into the common ink chamber 59 to return to the ink reflux passage 63.

For example, the actuator 54 of the inkjet head 2 is constituted by a unimorph type piezoelectric vibration plate on which a piezoelectric element 55 and a vibration plate 56 are laminated. For example, the piezoelectric element 55 is made of piezoelectric ceramic material such as the PZT (lead zirconate titanate). For example, the vibration plate 56 is formed by SiN (silicon nitride) and the like.

Figure 5:
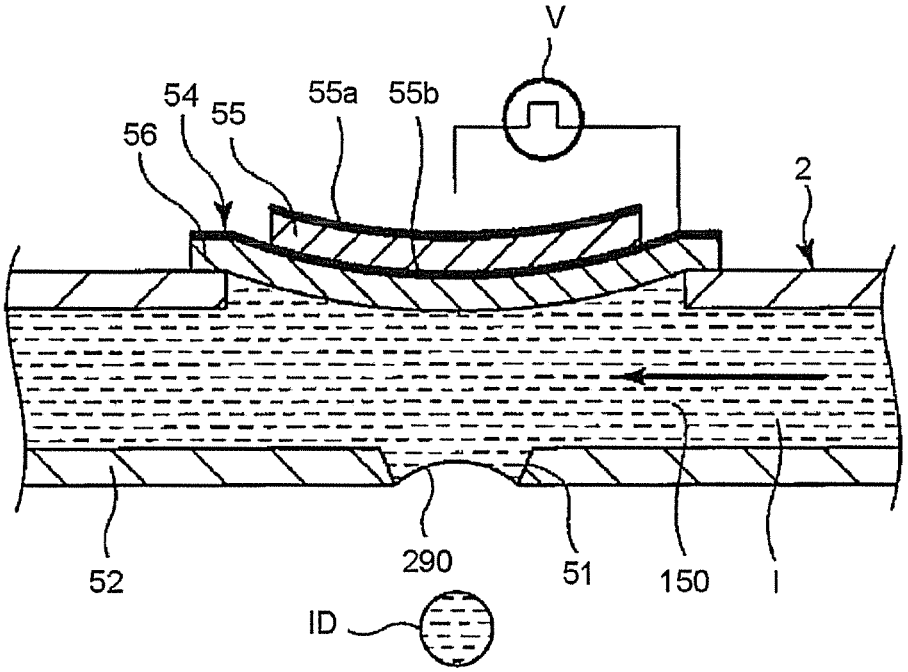
FIG. 5 is an illustration diagram illustrating a state in which ink droplets are ejected from the nozzle of the inkjet head according to the embodiment.

As shown in FIG. 4 and FIG. 5, the piezoelectric element 55 consists of an electrode 55*a* and an electrode 55*b* on the upper side and on the lower side, respectively. In a case in which no voltage is applied to the electrodes 55*a* and 55*b*, since the piezoelectric element 55 doesn't deform as shown in FIG. 4, the actuator 54 won't deform. In this case, a meniscus 290 serving as an interface between the ink I and the air is formed in the nozzle 51 through the surface tension of ink. The ink I in the ink pressure chamber 150 stays in the nozzle 51 through the meniscus 290.

If a voltage (V) is applied to the electrodes 55*a* and 55*b*, the piezoelectric element 55 deforms, and the actuator 54 deforms as shown in FIG. 5. Due to the deformation of the actuator 54, the pressure applied to the meniscus 290 becomes larger than the air pressure (positive pressure), and the ink I breaks the meniscus 290 to be an ink droplet ID to eject from the nozzle 51. Further, it is assumed that the air pressure is zero, and thus the negative pressure is smaller than the air pressure, and the positive pressure is larger than the air pressure.

As long as the inkjet head generates pressure fluctuation in the ink in the ink pressure chamber, no limitation is given to the constitution of the inkjet head. For example, the inkjet head may has a constitution in which the vibration plate deforms through the static electricity to eject the ink droplet, or has a constitution in which a heat energy such as a heater is used to eject the ink droplet from the nozzle. Further, as the viscosity of ink changes with temperature and the ejection characteristic of ink from the nozzle changes, a temperature sensor may be provided in the inkjet head to excellently control the ink ejection.

Figure 6:
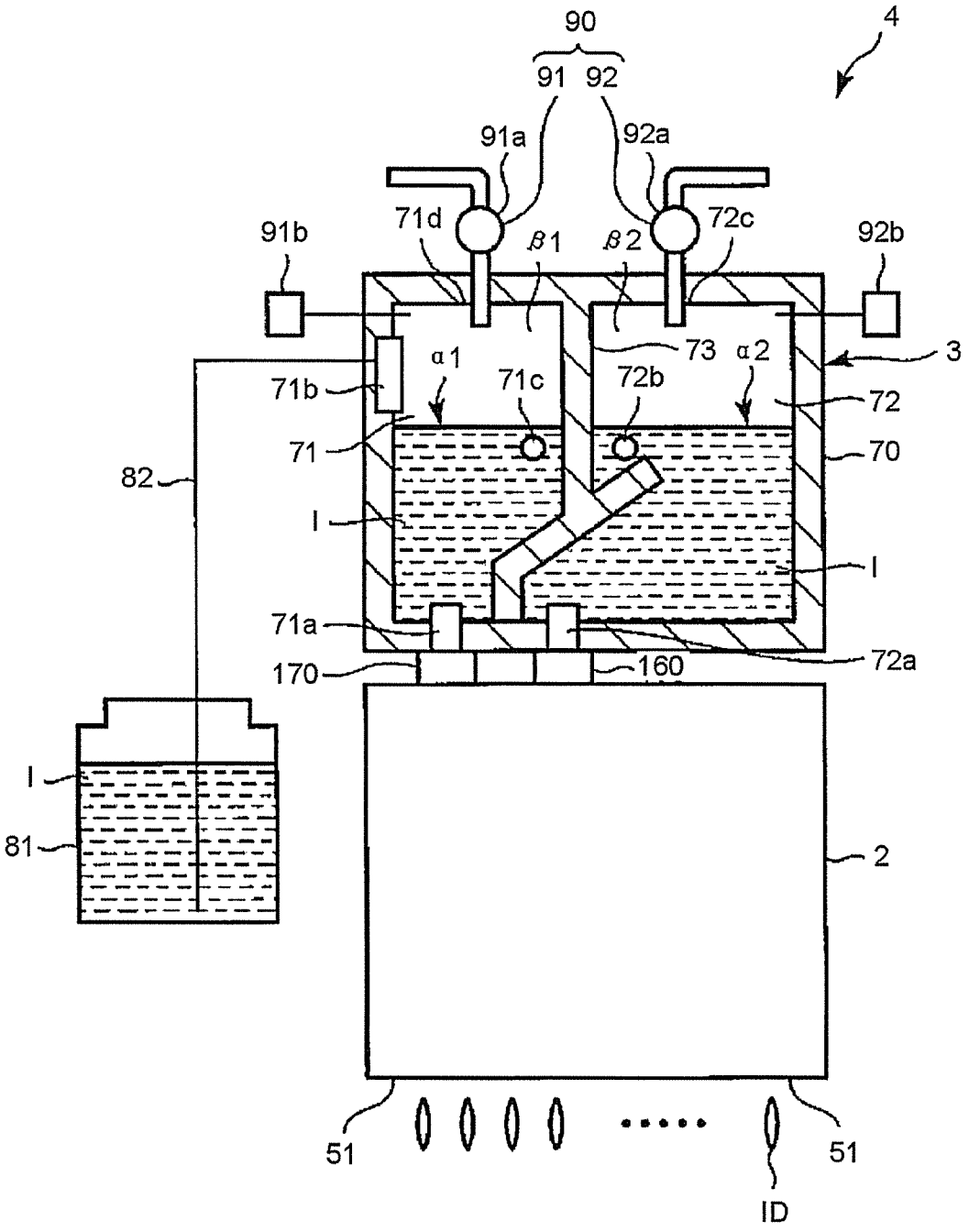
FIG. 6 is an illustration diagram illustrating an ink circulation apparatus according to the embodiment.
Figure 7:
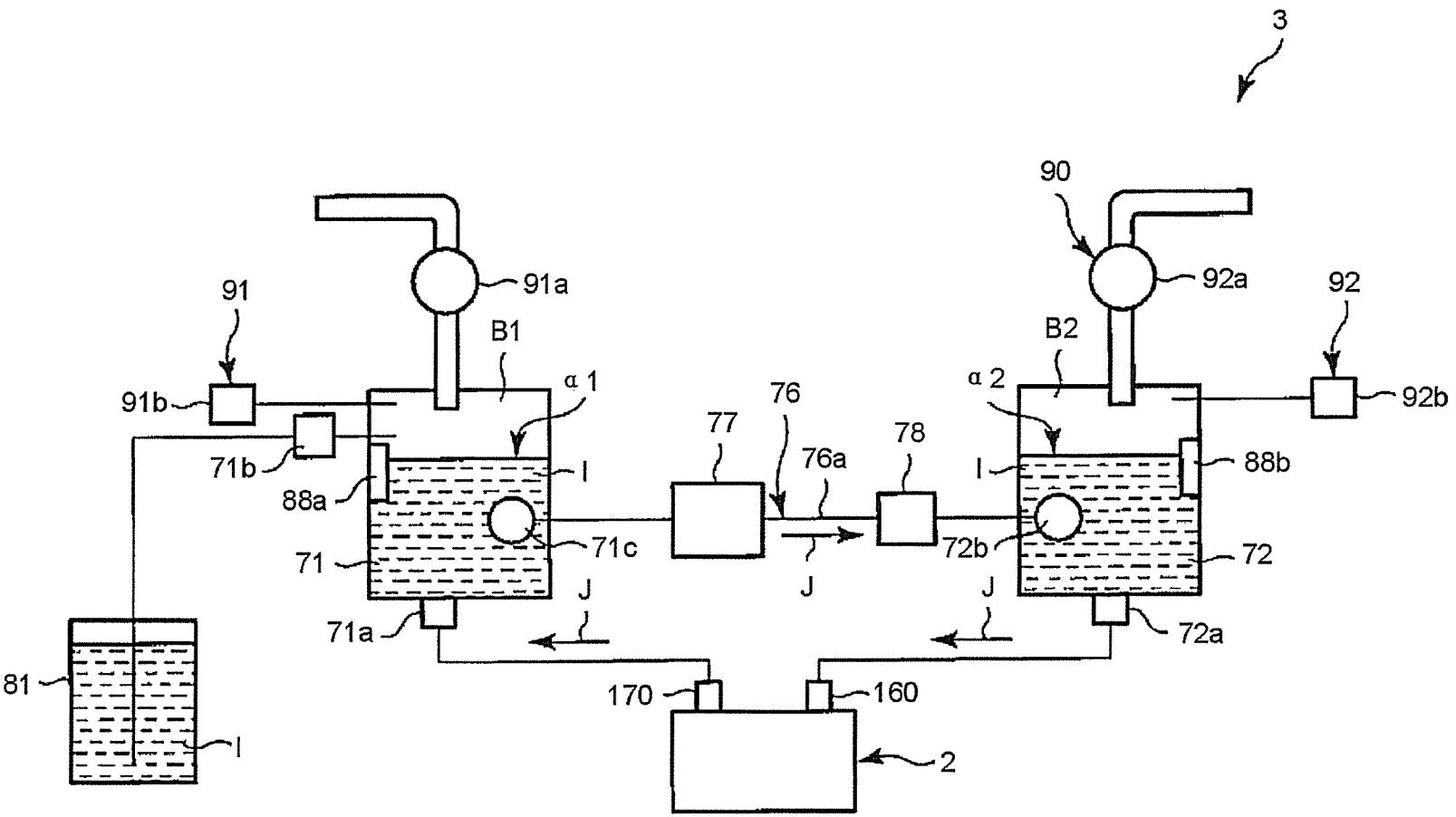
FIG. 7 is an illustration diagram illustrating ink circulation and a pressure adjustment section according to the embodiment.

For example, as shown in FIG. 6 and FIG. 7, the ink circulation device 3 comprises an ink casing 70 serving as an ink chamber (liquid chamber), a circulation section 76 and a pressure adjustment section 90 serving as an air replenishment section. The ink circulation device 3 circulates the ink to supply to the inkjet head 2, and adjusts the pressure in the inkjet pressure chamber 150 of the inkjet head 2. The ink circulation device 3 adjusts the pressure of the ink pressure chamber 150 to adjust the pressure of the meniscus 290 of the nozzle 51. The ink circulation device 3 circularly supplies the ink to the inkjet head 2 to absorb the air bubble contained in the ink I or to remove foreign substance.

If the pressure applied to the meniscus 290 of the nozzle 51 is larger than the air pressure (positive pressure), the inkjet head 2 enables the ink I to leak out from the nozzles 51. If the pressure applied to the meniscus 290 is smaller than the air pressure (negative pressure), the ink I maintains the meniscus 290 and stays in the nozzles 51.

For example, if the nozzles 51 are arranged in such a manner that the ink I ejects in the gravity direction (downward), and in a case in which the pressure in the ink pressure chamber 150 is larger than −0.5 kPa (positive pressure side), the ink I leaks out from the nozzles 51 due to little vibration. Further, in a case in which the pressure in the ink pressure chamber 150 is smaller than −4.0 kPa (negative pressure side), the air bubble is absorbed from the nozzles 51 and an ink ejection failure occurs. The ink circulation device 3 maintains the pressure of the meniscus 290 in a range of −4.0 kPa~−0.5 kPa to prevent the unnecessary ink leakage or sucking of air bubble.

The ink casing 70 comprises an ink collection chamber 71 collecting the ink I from the inkjet head 2, an ink supply chamber 72 supplying the ink I to the inkjet head 2, and a common wall 73 interposed between the ink collection chamber 71 and the ink supply chamber 72. The ink casing 70 is sealed against the fresh air. The ink collection chamber 71 holds the ink I forming a first liquid level $\alpha 1$, and constitutes a first air chamber $\beta 1$ above the first liquid level $\alpha 1$. The ink supply chamber 72 holds the ink I forming a second liquid level $\alpha 2$, and constitutes a second air chamber $\beta 2$ above the second liquid level $\alpha 2$.

The ink collection chamber 71 is provided with an ink return pipe 71*a*. The ink return pipe 71*a* communicates the ink collection chamber 71 with the ink discharge port 170 of the inkjet head 2. The ink I from the inkjet head 2 is returned to the ink collection chamber 71 through the ink return pipe 71*a*. The ink collection chamber 71 is provided with an ink supply pump 71*b*. The ink supply pump 71*b* is a liquid replenishment section, i.e., ink replenishment section. The ink supply pump 71*b* replenishes the ink collection chamber 71 with new ink from the ink cartridge 81 through a tube 82. The ink collection chamber 71 includes a liquid feeding hole 71*c* through which the ink to be fed to the circulation section 76 passes. The ink collection chamber 71 comprises a first communication hole 71*d* communicating with a first pressure adjustment section 91 of the pressure adjustment section 90.

The ink supply chamber 72 is provided with an ink supply pipe 72*a*. The ink supply pipe 72*a* communicates the ink supply chamber 72 with the ink supply port 160 of the inkjet head 2. The ink I flows into the inkjet head 2 through the ink supply port 160. The ink supply chamber 72 includes a discharge hole 72*b* through which the ink I to be fed from the circulation section 76 discharges. The ink supply chamber 72 comprises a second communication hole 72*c* communicating with a second pressure adjustment section 92 of the pressure adjustment section 90.

It is possible to perform a good ink circulation between the ink collection chamber 71, the ink supply chamber 72 and the inkjet head. Further, no limitation is given to the constitution of each of the ink collection chamber 71 and the ink supply chamber 72. For example, a heater for heating ink may be arranged to keep the temperature of ink in a given range.

By arranging the ink cartridge 81 relatively below the ink circulation device 3 in the gravity direction, the water head pressure of the ink in the ink cartridge 81 is kept to be smaller than a set pressure of the ink collection chamber 71. By arranging the ink cartridge 81 below the ink circulation device 3, the ink cartridge 81 supplies new ink to the ink collection chamber 71 only when the ink supply pump 71*b* is driven.

For example, the ink supply pump 71*b* is a piezoelectric pump. By bending the piezoelectric vibration plate on which the piezoelectric element and the metal plate are stuck, the ink supply pump 71*b* changes the volume of the pump (volume of pump chamber) periodically. In response to the change of the volume of the pump chamber, the ink supply pump 71*b* conveys the ink from the ink cartridge 81 to the pump chamber. The ink supply pump 71*b* sets the conveyance direction of ink to one direction from the ink cartridge 81 to the ink collection chamber 71 through a check value. If the pump chamber of the ink supply pump 71*b* expands according to the bending of the piezoelectric vibration plate, the ink flows into the pump chamber. If the pump chamber of the ink supply pump 71*b* contracts according to the bending of the piezoelectric vibration plate, the ink flows out from the pump chamber. By repeating the expansion and contraction of the pump chamber, the ink supply pump 71*b* feeds ink from the ink cartridge 81 to the ink collection chamber 71.

No limitation is given to the arrangement and position of the ink cartridge 81. For example, in a case in which the ink cartridge 81 is arranged at a position higher than that of the ink circulation device 3, the water head pressure of the ink in the ink cartridge 81 becomes larger than the set pressure of the ink collection chamber 71. In the case in which the ink cartridge 81 is arranged at a position higher than that of the ink circulation device 3, it is possible to supply ink from the ink cartridge 81 to the ink collection chamber 71 by opening and closing an electromagnetic valve using the water head difference.

As shown in FIG. 7, the circulation section 76 of the ink circulation device 3 comprises a circulation path 76*a* from the liquid feeding hole 71*c* of the ink collection chamber 71 to the discharge hole 72*b* of the ink supply chamber 72. The circulation section 76 comprises a circulation pump 77 and a filter 78 on a circulation path 76*a*. The circulation pump 77 is arranged extending between the adjacent ink collection chamber 71 and the ink supply chamber 72. As indicated by an arrow J, the circulation pump 77 circulates the ink I from the ink collection chamber 71 to the ink collection chamber 71 via the ink supply chamber 72 and the inkjet head 2. The circulation section 76 sucks ink from the liquid feeding hole 71*c* to feed the ink I through the discharge hole 72*b* to the ink supply chamber 72. As to the circulation pump 77, for example, a tube pump, a diaphragm pump, or a piston pump may be used.

The filter 78 is arranged, for example, at the downstream side in the circulation direction of the circulation pump 77 on the circulation path 76*a* to remove the foreign substance mixed in the ink I. As to the filter 78, for example, a polypropylene mesh filter, a nylon mesh filter, a polyphenylene sulfide mesh filter, or a stainless mesh filter may be used.

During a period the ink is circulated from the ink collection chamber 71 to the ink supply chamber 72 by the circulation section 76, the air bubbles in the ink I rise in a direction (upward direction) opposite to the gravity direction by buoyancy. The air bubbles rose by the buoyancy are moved to the air chambers β1, β2 respectively above the first liquid level α1 of the ink collection chamber 71 or the second liquid level α2 of the ink supply chamber 72 to be removed from the ink.

As shown in FIG. 7, the ink circulation device 3 comprises a first ink amount sensor (liquid level sensor) 88*a* which measures the ink amount of the ink collection chamber 71, and a second ink amount sensor (liquid level sensor) which measures the ink amount of the ink supply chamber 72. For example, the piezoelectric vibration plate is vibrated by an alternating voltage, the first ink amount sensor (liquid level sensor) 88*a* and the second ink amount sensor (liquid level sensor) 88*b* respectively detect the vibration of ink transmitted to the ink collection chamber 71 and the ink supply chamber 72 to detect the ink amount. As long as the ink amount sensor can measure the height is each of the first liquid level α1 and the second liquid level α2, no limitation is given to the constitution of the ink amount sensor.

As shown in FIG. 7, the ink circulation device 3 comprises a first pressure sensor 91*b* communicating with the first communication hole 71*d* of the ink collection chamber 71 and a second pressure sensor 92*b* communicating with the second communication hole 72*c* of the ink supply chamber 72. The first pressure sensor 91*b*, which is a pressure detection section, detects the pressure of the first air chamber β1 of the ink collection chamber 71. The second pressure sensor 92*b* (pressure detection section) detects the pressure of the second air chamber β2 of the ink supply chamber 72. No limitation is given to the constitution of each of the pressure sensors 91*b* and 92*b*. For example, the pressure sensors 91*b* and 92*b* use a semiconductor piezoresistive pressure sensor to output the pressure of the first air chamber β1 or the pressure of the second air chamber β2 as an electric signal. The semiconductor piezoresistive pressure sensor consists of a diaphragm which receives pressure from outside and a semiconductor distortion gauge which is formed on the surface of the diaphragm. The semiconductor piezoresistive pressure sensor converts the change of the electrical resistance under the piezoresistive effect that is generated in the distortion gauge along with the deformation of the diaphragm due to the pressure from the outside into an electrical signal to detect pressure.

The first pressure adjustment section 91 of the ink circulation device 3 comprises a first pressure adjustment pump 91*a*, and the second pressure adjustment section 92 comprises a second pressure adjustment pump 92*a*. The pressure adjustment pumps 91*a* and 92*a* respectively send air to the ink collection chamber 71 or the ink supply chamber 72 to increase the pressure in the circulation path 76*a*. The first and second pressure adjustment pump 91*a* and 92*a* respectively discharge the air in the ink collection chamber 71 or the air in the ink supply chamber 72 to outside to reduce the pressure in the circulation path 76*a*. For example, a tube pump or a bellows pump and the like may be used as the pressure adjustment pump 91*a* and the pressure adjustment pump 92*a*.

Figure 8:
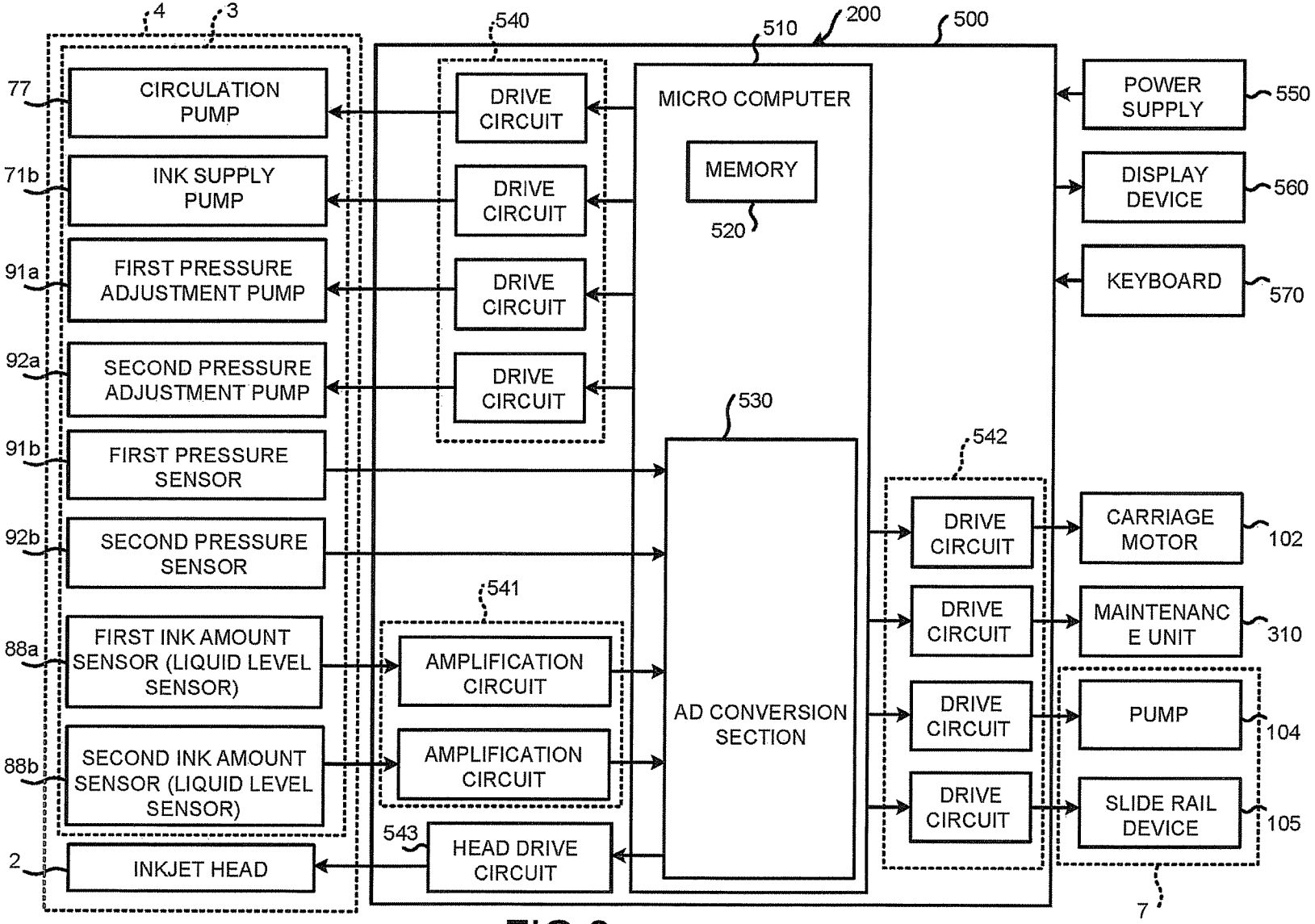
FIG. 8 is a block diagram illustrating a control system of the inkjet recording apparatus according to the embodiment.

A control system 200 controlling the operations of the inkjet recording apparatus 1 is described with reference to the block diagram shown in FIG. 8. A control substrate 500 of the control system 200 comprises a microcomputer 510 (control section) which controls the entire inkjet recording apparatus 1, a circulation device drive circuit 540 which drives the ink circulation device 3, an amplification circuit 541, a movement section drive circuit 542 which drives the image receiving medium movement section 7, and a head drive circuit 543 which drives the inkjet head 2. The inkjet recording section 4 includes the ink circulation device 3 and the inkjet head 2. The microcomputer 510 comprises a memory 520 which stores programs, various kinds of data and the like, and an AD conversion section 530 which acquires an output voltage from the ink circulation device 3 of the inkjet recording section 4.

The control substrate 500 is connected with a power supply 550, a display device 560 which displays the status of the inkjet recording apparatus 1 and a keyboard 570 serving as an input device. The control substrate 500 is connected with the driving section of each pump of the inkjet recording section 4 and various sensors. The control substrate 500 is connected with the pump 104 of the image receiving medium movement section 7, the slide rail device 105, the driving section of the maintenance unit 310 and the carriage motor 102 of the conveyance belt 101.

Hereinafter, a liquid ejection method of the inkjet recording apparatus 1 is described. In a case in which the inkjet recording apparatus 1 performs printing operation initially, the ink I is filled from the ink cartridge 81 to the inkjet recording section 4. In order to fill the ink I, the microcomputer 510 enables the inkjet recording section 4 to return to the standby position, lifts the maintenance unit 310 in the direction indicated by the arrow D to cover the nozzle plate 52. The microcomputer 510 drives the ink supply pump 71*b* to feed ink from the ink cartridge 81 to the ink collection chamber 71. If the ink I reaches the liquid feeding hole 71*c* in the ink collection chamber 71, the microcomputer 510 adjusts the pressure of the ink casing 70 through the pressure adjustment section 90 to drive the circulation pump 77. When the ink I reaches the liquid feeding hole 71*c* of the ink collection chamber 71 and the discharge hole 72*b* of the ink supply chamber 72, the microcomputer 510 completes the initial filling of the ink I.

The inkjet recording apparatus 1 initially fills the inkjet recording sections 4*a*, 4*b*, 4*c*, 4*d* and 4*e* with cyan ink, magenta ink, yellow ink, black ink and white ink of the ink cartridges 81*a*, 81*b*, 81*c*, 81*d* and 81*e*, respectively.

In a case in which the initial filling of the ink I is completed, the pressure in the ink casing 70 is maintained to be a negative pressure under which the ink I won't leak out from the nozzles 51 of the inkjet head 2 and the air bubbles are not sucked from the nozzles 51. Through the negative pressure of the ink casing 70, the nozzle 51 maintains a negative pressure of the meniscus 290. Even in a case in which the power supply 550 of the inkjet recording apparatus 1 is cut off in a state in which the initial filling of the ink I is completed, the ink casing 70 is in a sealed state, and the meniscus 290 in the nozzle 51 is maintained under a negative pressure to prevent the leakage of ink.

When the print is started, the microcomputer 510 controls the image receiving medium movement section 7 to adsorp and fix the image receiving medium S to and on the table 103, and enables the table 103 to reciprocate in the direction indicated by the arrow B. The microcomputer 510 moves the maintenance unit 310 in the direction indicated by the arrow C. Further, the microcomputer 510 controls the carriage motor 102 to convey the carriage 100 in the direction of the image receiving medium S, and enables it to reciprocate in the direction indicated by the arrow A.

The microcomputer 510 selectively drives the actuator 54 of the inkjet head 2 according to an image signal corresponding to the image data stored by the memory 520 (for example) to eject the ink droplet ID from the nozzle 51 to the image receiving medium S. The microcomputer 510 drives the circulation pump 77. The ink I returned from the inkjet head 2 circulates via the ink collection chamber 71, the filter 78 and the ink supply chamber 72, and then is supplied to the inkjet head 2.

By circulating the ink I, the inkjet recording apparatus 1 removes the air bubble and foreign substance mixed in the ink I to keep a good ink ejection property, and a print image quality by the inkjet recording section 4 improves.

The pressure of the ink casing 70 fluctuates according to the ejection of the ink droplet ID from the nozzles 51 or the driving of the circulation pump 77 and the like. In order to maintain the pressure of the ink casing 70 in a stable range in which the ink won't leak out from the nozzles 51 or the air bubble won't be sucked from the nozzles 51, the microcomputer 510 adjusts the pressure of the ink casing 70.

The microcomputer 510 switches the driving of each of the pressure adjustment pumps 91*a* and 92*a* of the pressure adjustment section 90 and the driving of the ink supply pump 71*b* to adjust the pressure of the ink casing 70.

For example, when the ink droplet ID ejects from the nozzle 51 at the time of print, the ink amount in the ink casing 70 decreased instantaneously and the pressure of the ink collection chamber 71 reduces. When the first pressure sensor 91*b* detects the reduction of the pressure of the ink collection chamber 71, the microcomputer 510 drives the pressure adjustment section 90 and the ink supply pump 71*b* according to the detection results of the first pressure sensor 91*b*, the second pressure sensor 92*b*, the first ink amount sensor (liquid level sensor) 88*a* and the second ink amount sensor (liquid level sensor) 88*b*.

Figure 9:
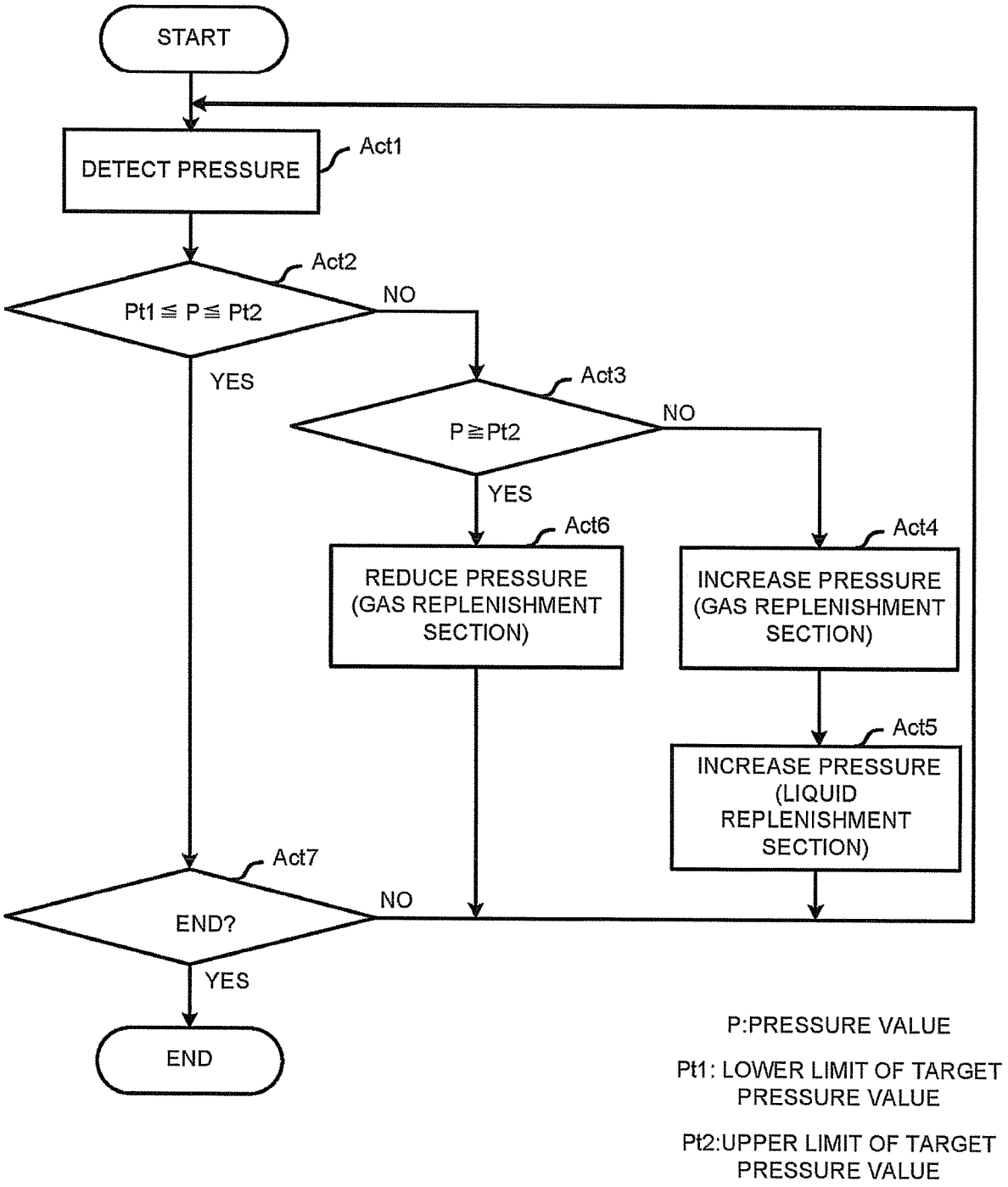
FIG. 9 is a flowchart illustrating a pressure adjustment procedure according to the embodiment.
Figure 10:
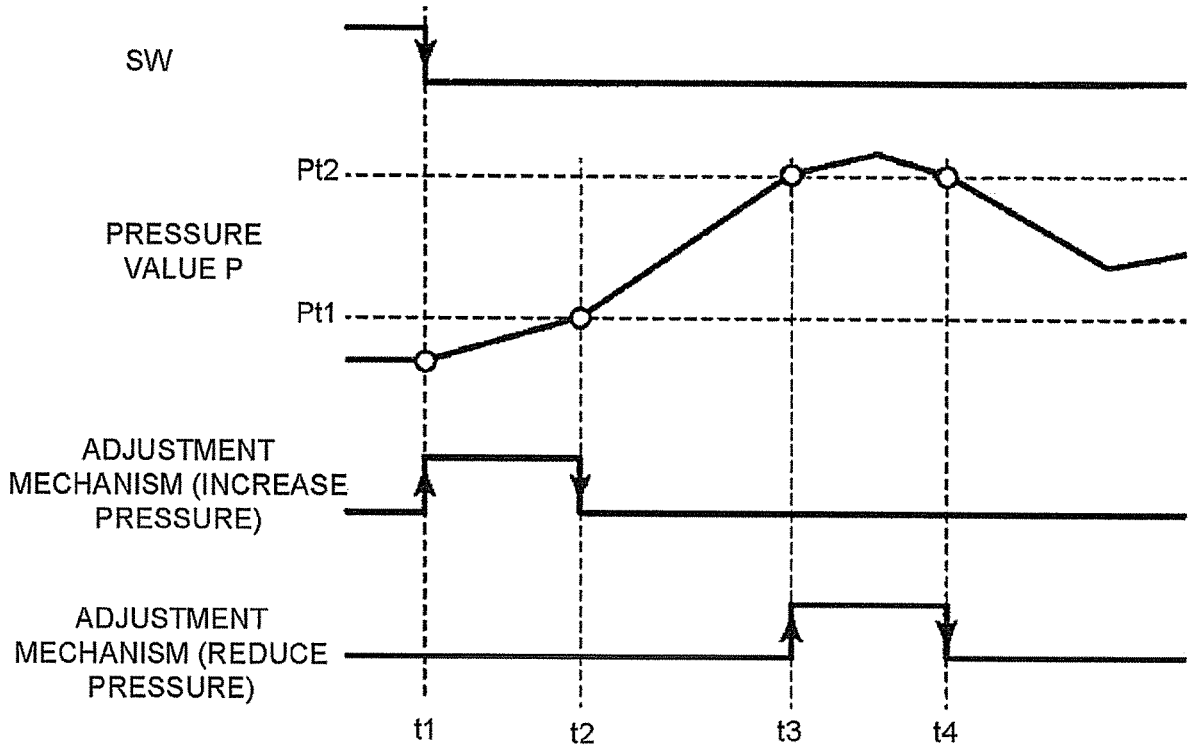
FIG. 10 is an illustration diagram illustrating pressure adjustment according to the embodiment.
Figure 11:
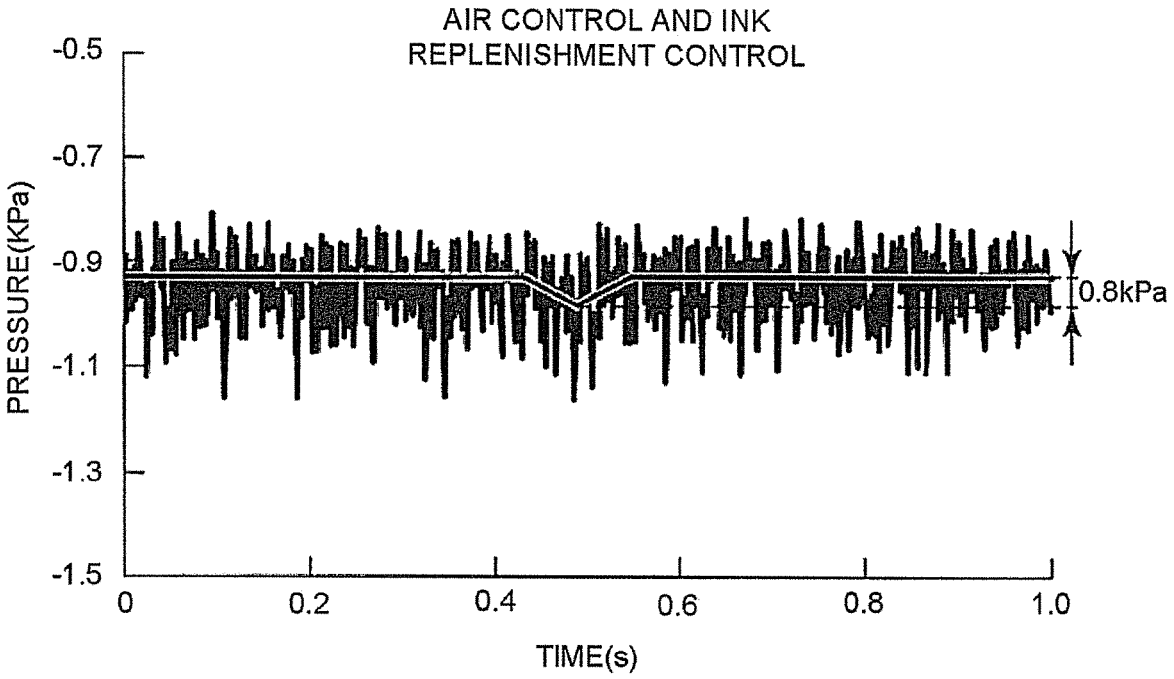
FIG. 11 is a graph of pressure values in a case of carrying out the pressure adjustment under an air control and an ink replenishing control according to the embodiment.

A pressure adjustment method for adjusting the pressure applied to the nozzle 51 is described with reference to FIG. 9~FIG. 11. FIG. 9 is a flowchart illustrating a pressure adjustment procedure. FIG. 10 is a timing chart illustrating the pressure adjustment. FIG. 11 is a graph of pressure values in a case of carrying out the pressure adjustment under an air control and an ink replenishing control.

For example, it is assumed that the lower limit value of the stable range of the pressure values P of the nozzle 51 is Pt1 and the upper limit value is Pt2. The stable range is a range in which the ink won't leak out from the nozzles 51 or the air bubble won't be sucked from the nozzles 51 in the inkjet recording section 4.

As shown in FIG. 9 and FIG. 10, after the power supply 550 is input at a time t1, the pressure value P of the nozzle 51 is calculated (Act 1) based on the pressure value of the ink collection chamber 71 detected by the first pressure sensor 91*b* and the pressure value of the ink supply chamber 72 detected by the second pressure sensor 92*b*. Then, it is determined whether the pressure value P is in the stable range, that is, whether the pressure value P meets the relation: $Pt1 \leq P \leq Pt2$ (Act 2). In a case in which the pressure value P doesn't meet the relation: $Pt1 \leq P \leq Pt2$, it is determined that whether or not the pressure value P is greater than the upper limit value of the stable range, that is, whether the pressure value P meets the relation: $P \geq Pt2$ (Act 3). In a case in which the pressure value P doesn't meet the relation: $Pt1 \leq P \leq Pt2$ (NO in Act 2) and the pressure value P doesn't meet the relation: $P \geq Pt2$ (NO in Act 3), that is, in a case in which the pressure value P is smaller than the lower limit value Pt1, the microcomputer 510 drives the first pressure adjustment pump 91*a* and the second pressure adjustment pump 92*a* to acquire the fresh air into the ink casing 70, and in this way, a pressure increase adjustment is performed (Act 4). Further, the microcomputer 510 drives the ink supply pump 71*b* to replenish new ink to the ink casing 70, and in this way, the pressure of the ink casing 70 is adjusted and increased (Act 5). That is, during a period the ink I is ejected from the nozzles 51 to carry out the print operation, the fresh air is acquired into the ink casing 70 and the new ink is replenished from the ink cartridge 81 to the ink collection chamber 71, the inkjet recording section 4 increases and adjusts the pressure of the nozzles with the first pressure adjustment pump 91*a*, the second pressure adjustment pump 92*a* and the ink supply pump 71*b*.

For example, as a time t2 shown in FIG. 10, when the pressure value P of the nozzle 51 reaches a range from the lower limit value Pt1 to the upper limit value Pt2 and meets the relation: Pt1≤P≤Pt2 (YES in Act 2), the microcomputer 510 stops the pressure increase adjustment.

For example, as a time t3 shown in FIG. 10, when the pressure value P of the nozzle 51 is greater than the upper limit value Pt2 (YES in Act 3), the microcomputer 510 discharges the air in the ink casing 70 to outside through the first pressure adjustment pump 91*a* and the second pressure adjustment pump 92*a* to reduce and adjust the pressure of the nozzle 51 (Act 6).

For example, as a time t4 shown in FIG. 10, when the pressure value P of the nozzle 51 reaches a range from the lower limit value Pt1 to the upper limit value Pt2 (YES in Act 2), the microcomputer 510 stops the pressure reduction adjustment.

The operations described above (Act 1~Act 6) are repeated until the operations are ended (Act 7) because, for example, the power supply is turned off.

Figure 12:
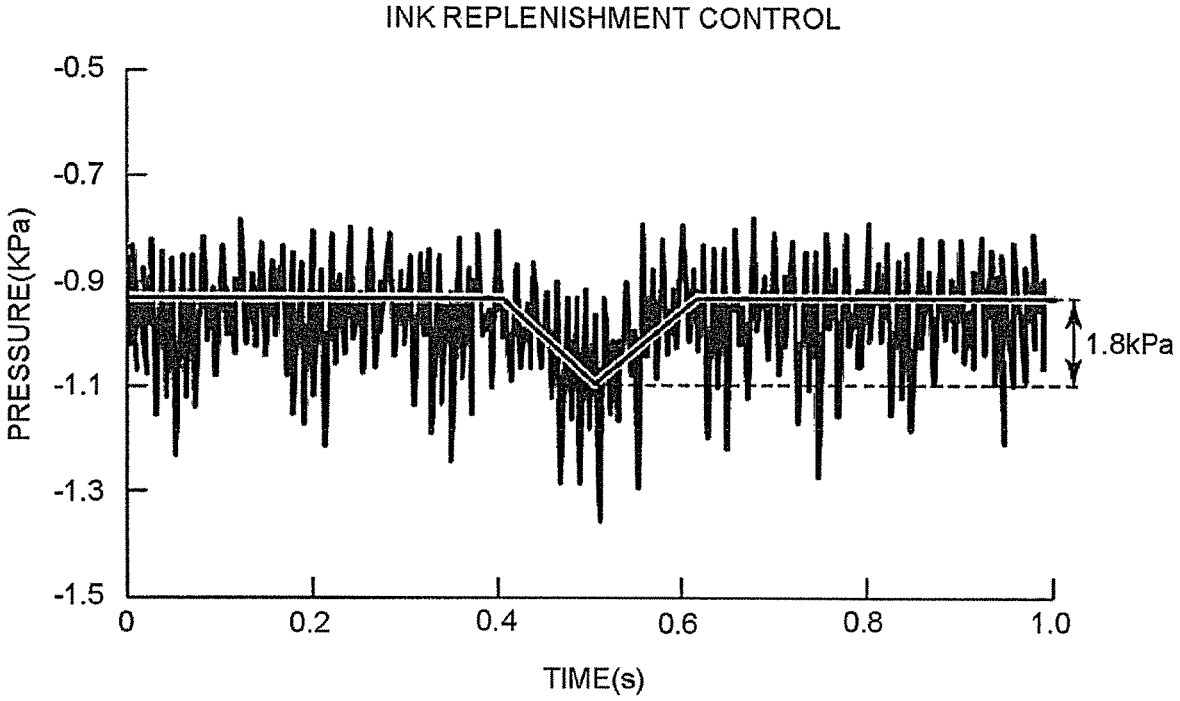
FIG. 12 is a graph of pressure values in a case of carrying out the pressure adjustment under an ink replenishing control.

In accordance with an embodiment, it is possible to accelerate the response to the pressure adjustment and to reduce the fluctuation value of the pressure at the time of liquid ejection. Thus, the variation of ejection volume can be reduced and the image disorder can be suppressed. The inkjet recording section 4 simultaneously use the driving of the first pressure adjustment pump 91*a* and the second pressure adjustment pump 92*a* and the driving of the ink supply pump 71*b* to increase and adjust the pressure value P of the nozzle 51. As shown in FIG. 11, in a case of carrying out the simultaneous pressure increase adjustment, the fluctuation value of the pressure average value is about 0.8 kPa in the environment in the present embodiment. On the contrary, as a comparative example shown in FIG. 12, in a case of performing a pressure increase adjustment only by replenishing new ink from the ink cartridge 81 to the ink collection chamber 71, the fluctuation value of the pressure average value is about 1.8 kPa. The smaller the fluctuation value of the pressure is, the smaller the variation of ejection volume of the ink I ejected from the nozzle 51 is, and thus the inkjet recording apparatus can obtain a good image. As stated above, by simultaneously acquiring the fresh air into ink casing 70 and replenishing new ink from the ink cartridge 81 to the ink collection chamber 71, it is easy to obtain a good image.

The inkjet recording section 4 circulates the ink I with the ink circulation device 3 to remove the air bubbles or the foreign substance contained in the ink I. An excellent ink ejection property of the inkjet head 2 is kept to improve the print image quality of the inkjet recording section 4.

Even if the inkjet recording section 4 is in the pressure adjustment process of the print operations, the inkjet recording section 4 can replenish new ink I from the ink cartridge 81 to the ink casing 70. Thus, the inkjet recording section 4 can replenish the ink I to the ink casing 70 during a period the pressure P of the nozzle 51 is being adjusted without stopping the print operations, and thus it is possible to prevent the reduction of the print production efficiency of the inkjet recording apparatus 1.

No limitation is given to the constitution of the liquid circulation apparatus according to the embodiment described above. For example, as long as the liquid can be replenished to the liquid chamber and the liquid can be circulated, the liquid chamber and the liquid ejection section may also not be formed integrally. Further, the liquid circulation apparatus can also eject liquid other than ink. As a liquid ejection apparatus which ejects liquid other than ink, for example, it may be an apparatus which ejects liquid including conductive particles for forming a wiring pattern of a printed wiring substrate.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A liquid replenishment apparatus, comprising:

a casing configured to form a liquid chamber configured to hold liquid which is to be supplied to a liquid ejecting head ejecting liquid and connected to the liquid ejecting head;

a pressure sensor configured to detect the pressure in the casing;

a liquid replenishment pump configured to replenish liquid to the casing;

a gas replenishment pump configured to replenish gas to the casing, and a controller configured to calculate a pressure value of the liquid ejecting head based on a pressure value of the casing detected by the pressure sensor, if the pressure value of the liquid ejecting head is smaller than a lower limit value of a predetermined range, first add pressure in the casing by replenishing the gas to the casing with the gas replenishment pump, and then replenish the liquid to the casing with the liquid replenishment pump after adding pressure by replenishing the gas.

2. The liquid replenishment apparatus according to claim 1, wherein the gas replenishment pump can discharge the gas in the liquid chamber, and adjusts the pressure in the casing by replenishing the liquid, replenishing the gas and discharging the gas.

3. The liquid replenishment apparatus according to claim 1, wherein the controller is configured to control the gas replenishment pump based on the pressure of the liquid chamber detected at the pressure sensor.

4. The liquid replenishment apparatus according to claim 2, wherein the controller is configured to control the gas replenishment section pump based on the pressure of the liquid chamber detected at the pressure sensor.

5. The liquid replenishment apparatus according to claim 1, wherein the casing forms a collection chamber collecting the liquid from the liquid ejecting head, and a supply chamber supplying the liquid to the liquid ejecting head.

6. The liquid replenishment apparatus according to claim 1, wherein the casing is arranged above the liquid ejecting head to be integral with the liquid ejecting head.

7. A liquid ejection apparatus, comprising:

a liquid ejecting head configured to comprise a nozzle which ejects liquid;

a casing configured to form a liquid chamber configured to hold liquid which is to be supplied to the liquid ejecting head ejecting liquid and connected to the liquid ejecting head;

a pressure sensor configured to detect the pressure in the casing;

a liquid replenishment pump configured to replenish liquid to the casing; and a gas replenishment pump configured to replenish gas to the casing; and a controller configured to calculate a pressure value of the liquid ejecting head based on a pressure value of the casing detected by the pressure sensor, if the pressure value of the liquid ejecting head is smaller than a lower limit value of a predetermined range, first add pressure in the casing by replenishing the gas to the casing with the gas replenishment pump, and then replenish the liquid to the casing with the liquid replenishment pump after adding pressure by replenishing the gas.

8. The liquid ejection apparatus according to claim 7, wherein the gas replenishment pump can discharge the gas in the liquid chamber, and adjusts the pressure in the casing by replenishing the liquid, replenishing the gas and discharging the gas.

9. The liquid ejection apparatus according to claim 7, wherein the controller is configured to control the gas replenishment pump based on the pressure of the liquid chamber detected at the pressure sensor.

10. The liquid ejection apparatus according to claim 8, wherein the controller is configured to control the gas replenishment pump based on the pressure of the liquid chamber detected at the pressure sensor.

11. The liquid ejection apparatus according to claim 7, wherein the casing forms a collection chamber collecting the liquid from the liquid ejecting head, and a supply chamber supplying the liquid to the liquid ejecting head.

12. The liquid ejection apparatus according to claim 7, wherein the casing is arranged above the liquid ejecting head to be integral with the liquid ejecting head.

* * * * *